US005377856A

United States Patent [19]

Brierton

[11] Patent Number: 5,377,856

[45] Date of Patent: Jan. 3, 1995

[54] AIR CARGO SECURITY VAULT

[76] Inventor: Dennis M. Brierton, 1678 Langport Dr., Sunnyvale, Calif. 94087

[21] Appl. No.: 38,025

[22] Filed: Mar. 29, 1993

[51] Int. Cl.[6] ..... B05D 7/00

[52] U.S. Cl. ..... 220/1.5; 220/4.28; 220/4.33; 220/345

[58] Field of Search ..... 206/1.5, 4.28, 4.33, 206/345

[56] References Cited

U.S. PATENT DOCUMENTS

| | | | |
|---|---|---|---|
| 1,740,000 | 12/1929 | Andrews et al. | 220/1.5 |
| 3,040,925 | 6/1962 | Mills | 220/1.5 |
| 3,456,828 | 7/1969 | Busha et al. | 220/1.5 |
| 3,485,406 | 12/1969 | Borden | 220/1.5 |
| 3,561,634 | 2/1971 | Meldrum | 220/1.5 |
| 3,563,403 | 6/1971 | Luisada | 220/1.5 |
| 3,575,312 | 4/1971 | Luisada | 220/1.5 |
| 3,598,273 | 8/1971 | Rau et al. | 220/1.5 |
| 3,672,529 | 6/1972 | Fedderson et al. | 220/1.5 |
| 3,828,965 | 1/1974 | Yarborough | 220/1.5 |
| 3,860,138 | 1/1975 | Lovich et al. | 220/1.5 |
| 3,904,064 | 8/1975 | Looker | 220/1.5 |
| 3,907,148 | 9/1975 | Meller et al. | 220/1.5 |
| 3,915,327 | 10/1975 | Lovich et al. | 220/1.5 |
| 3,955,700 | 5/1976 | DeJesus | 220/1.5 |
| 3,968,895 | 4/1976 | Barnes et al. | 220/1.5 |
| 3,972,437 | 4/1976 | Lovich et al. | 220/1.5 |
| 4,046,277 | 7/1977 | Morrison | 220/1.5 |
| 4,046,278 | 7/1977 | Chieger et al. | 220/1.5 |
| 4,192,430 | 3/1980 | Corhou | 220/1.5 |
| 4,212,406 | 7/1980 | Mittelmann | 220/1.5 |
| 4,493,428 | 1/1988 | Mittelmann et al. | 220/1.5 |
| 4,574,968 | 3/1986 | Mittelmann | 220/1.5 |
| 4,601,405 | 2/1980 | Riemer | 220/1.5 |
| 4,674,645 | 6/1987 | Instone et al. | 220/1.5 |
| 4,747,504 | 11/1988 | Wiseman et al. | 220/1.5 |
| 4,795,047 | 1/1989 | Dunwoodie | 220/1.5 |
| 4,799,600 | 8/1989 | Gunn et al. | 220/1.5 |
| 4,802,600 | 8/1989 | Bretschneider et al. | 220/1.5 |
| 4,860,912 | 8/1989 | Kupersmit | 220/1.5 |
| 4,998,634 | 7/1991 | Nessfield | 220/1.5 |
| 5,019,998 | 5/1992 | Bretschneider | 220/1.5 |
| 5,279,437 | 1/1994 | Kupersmit | 220/1.5 |

OTHER PUBLICATIONS

"Journal of Commerce", Jun. 1, 1992.
"Journal of Commerce", Jan. 25, 1993.

*Primary Examiner*—Joseph Man-Fu Moy
*Attorney, Agent, or Firm*—Thomas E. Schatzel

[57] ABSTRACT

An air cargo container (1) for use as an integral part of the aircraft. It is adaptable to any of numerous options while maintaining basic structural and functional concepts. Fundamentally, it comprises a floor (7) enclosed by a body (2) having an opening (12) in one wall that, except for modest top and side edges, enables substantially full access for loading and unloading. A rigid, removable door panel (8) with a structural flange (17) directly engages with a structural channel (13) or similar surface to create a watertight seal around the opening (12) and the door panel (8) is tightened to the floor (7) by a stationary tie-down means (18,19). The door panel (8) overlaps the edges (9) of the body (2) that surround the opening (12), providing a superior seal and protective barrier to environmental elements and pilferage, and superior structural strength. The door panel (8) distributes evenly around the edges (9) any weight stresses against the door panel (8).

15 Claims, 3 Drawing Sheets

AIR CARGO SECURITY VAULT

BACKGROUND—FIELD OF INVENTION

This invention relates to air cargo containers that are certified for use as an integral part of an aircraft.

BACKGROUND—DESCRIPTION OF PRIOR ART

Overview of the use of air cargo containers in the air-freight industry

Cargo that is transported by commercial aircraft is placed in a cargo container. The container gives the cargo a physical space for being loaded at the point of departure and unloaded at the final destination. The container is intended to enclose and protect the cargo during transport and flight.

The container must be able to hold up to several thousand

The container must be able to hold up to several thousand pounds of cargo, and yet be relatively light in weight. It must also have sufficient structural strength to protect the cargo from the rigors of jostling and impacts that inevitably occur during the loading and unloading process, during transport, and during a turbulent flight.

After cargo is placed in the container, the container is loaded onto a truck or trailer by forklift and then driven to the aircraft. It is then loaded into the aircraft by a K-loader, forklift, or other mechanical device that can elevate the loaded container to an opening in the aircraft. Once inside the aircraft, the container is then rolled on a floor containing ball transfer units into a particular area of the aircraft. The container is specifically designed to fit into a specific area or deck of the aircraft. The container is attached to the aircraft by special locks commonly referred to as "bear traps" that clamp down the container's floor to the aircraft in a predetermined configuration.

Containers have been manufactured and used in various configurations.

Air cargo containers using fabric and nonrigid materials

Originally, containers were often made of fabric-like material that was framed over a semi-rigid pallet. This method was viewed in the air cargo industry as inexpensive, easy to use, and usually adequate for shipping cargo safely. However, the industry learned through years of experience that where the container has one or more sides made of a soft fabric material, it has the serious disadvantage of providing no structural support or protection for the cargo during the rigors of loading, unloading, transport to the aircraft, and during the flight. The dollar cost of damage to cargo and from theft of cargo—particularly cargo consisting of fragile or high-value items—is a significant expense to air cargo carriers and their customers alike.

Typically, the shipping customer is compensated to some degree by the carrier for stolen or damaged cargo, but the compensation is often as meager as ten cents on the dollar. The customer ends up bearing the rest of the loss. Carriers will make more generous concessions to clients who regularly ship a large amount of goods on their air freight line. The smaller customer particularly suffers when its cargo is damaged or stolen.

U.S. Pat. No. 5,109,998 to Bretschneider (1992) discloses a multi-panel container with a fiber-covered front opening. This kind of fiber material can be easily ripped open with a sharp instrument, making pilferage of cargo a hazard.

This fabric front also has the disadvantage of lacking structural security necessary to protect the cargo from impacts from outside the container. Cargo is often loaded and unloaded in crowded areas or confined warehouse facilities. Forklifts, handtrucks, and other heavy equipment is moving around in aisles and between containers. Forklift blades inadvertantly slam into containers and, if this happens to a container made of fabric, the cargo absorbs most of the impact directly and is often damaged.

Fabric-based containers are also vulnerable to damage while being transported to the aircraft and loaded aboard. During this loading process and during the actual flight to the destination, the cargo tends to "settle" inside the container, moving downward and out toward the outer edge of the container's floor. This movement of hundreds or thousand pounds of cargo creates a strong outward push against the walls of the container. If the wall has a covering of fabric, netting, or some other non-rigid material, this settling puts a severe strain on the points where the covering connects to the container. The covering is pushed out, and stress is put on the connection points and fasteners. This distortion places undue stress on the curtain and net (or other covering) and may cause the container to become stuck in the truck or trailer, or in the aircraft itself.

The increased movement of cargo due to this lack of restraint may cause cargo to fall out of the container through a curtain and net, or other covering, thus increasing the risk of damage.

Any sharp corner or piece of cargo pushing from the inside of the container can cut or tear the fabric, leaving the cargo unprotected from environmental elements such as rain, wind, dirt or dust, jet exhaust, and smoke. This exposes cargo to possible affects or damage. Even when the fabric is not torn or damaged, it is quite permeable to the elements and provides only a modest barrier to their effects.

U.S. Pat. No. 5,109,998 also has the disadvantage of limited accessability for loading. It has a significant amount of "dead space" on one side of the container's front end. U.S. Pat. Nos. 4,802,600 to Bretschneider, et. al. (1989), 4,799,600 to Gunn, et. al. (1989), and 4,574,968 to Mittelmann (1986) have the same basic disadvantages discussed above.

Similarly, U.S. Pat. No. 3,456,828 to Busha, et. al. (1967) discloses a cover of strippable film draped over a framework of columns by a series of lacing, cleats, and a tear cord wound around the outside of the columns. U.S. Pat. No. 4,860,912 to Kupersmit (1989) reflects similar structural and security disadvantages. The body of this collapsible container is constructed of corrugated cardboard. This design provides only minor structural protection for the cargo. This container also requires a cargo net over the roof, walls, and double doors in order to sufficiently hold the container together for transport. Containers such as this whose structural integrity depends on cargo nets stretched over a significant portion of the body have the additional disadvantage of susceptibility to getting caught or snagged, particularly by forklift blades or while the container is being loaded or unloaded onto the trailer or aircraft. The cargo nets experience significant wear and tear and may fray or break during transport, threatening the structural integrity of the container.

A further disadvantage of U.S. Pat. No. 3,456,828 is that its loading access is quite limited. Although it has a double door, the total opening provided by these doors is a small portion of the container's front wall. Thus, while the cardboard construction provides somewhat more rigidity than soft fabric coverings, the small opening limits the use of this container for shipping large objects. The small opening also increases the time and effort required to load the container.

Air cargo containers using removable doors in conjunction with channels and hinges Attempts have been made to develop air cargo containers with greater strucural strength and fuller access for loading and unloading. U.S. Pat. No. 4,747,504 to Wiseman, et. al. discloses a front door made up of panels that slide in vertically into channels around the front opening and which utilize hinges for movement and latches for keeping the door panels in place. U.S. Pat. No. 4,493,428 to Mittelmann, et. al. (1985) discloses a similar approach consisting of a two-piece door with an upper and lower panel with a row of hinges arranged horizontally between those panels. The door is also hinged at the upper panel's top edge to the upper edge of the container's front opening. U.S. Pat. Nos. 3,955,700 to De Jesus Pedraza (1976), 3,860,138 to Lovich, et. al. (1975) and 3,672,529 to Fedderson, et. al. (1972) disclose a similar approach to a two-piece hinged door.

U.S. Pat. No. 3,915,327 to Lovich, et. al. (1975) discloses a similar approach consisting of three door panels. The side doors slide into a channel with a bevelled wedge that engages with a channel in the base of the container.

These types of units that require mutiple hinges and multi-panel doors for enclosure provide a more rigid material for enclosure than containers relying on fabric or cardboard. However, they experience significant disadvantages in actual use. First, laterally-opening hinged doors project outward. This makes operation difficult in crowded areas or confined spaces. Containers with side hinges project beyond the surface plane of the side having such a door. So, the door, even when it is closed, adds to the difficulty of handling and shipping such a container.

Also, in multiple-door containers the door panels themselves are fragile, particularly if they are designed to slide or pivot into a narrow channel around the container's opening. If the door panel is hit by a forklift or other object, the door may break or be bent out of shape. These stresses can distort the "fit" between the door panel and the channel into which it must fit. Because the door panels and channels must all fit together perfectly to provide a barrier against water and outside environmental elements, a damaged or distorted hinge or channel exposes cargo to water and other damaging elements.

Containers that rely on hinges are vulnerable to damage. A hinge mechanism is a moving part and is not typically designed to withstand heavy stresses or impacts. It can be damaged if an impact from either outside the container occurs, or if the cargo shifts around inside the container during transport and pushes hard into the door panels. When the hinge is damaged, it may bind and thus prevent proper opening and closure of the door panels. This adds to the risk of damage from water and other environmental elements.

The reliance on an inherently vulnerable mechanical part like a hinge also increases the number of auxiliary or "back-up" fixtures that must be used on the container and maintained. Specifically, when hinges are used on container doors, it is almost a necessity that some kind of sliding lock mechanism be placed across the hinges to add some structural integrity. This approach is disclosed in U.S. Pat. No. 3,907,148 to Meller, et. al. (1975). If one lock is inoperable, the door will not be secure, even though from a visual inspection it may mistakenly appear to be secure.

Containers whose doors rely on hinges and latches can also be pilfered rather easily. A screwdriver can be used to quietly dismantle enough hinges to remove the hinged panel or door.

U.S. Pat. No. 3,904,064 to Looker (1975) discloses a design with one or more of the door panels pivotable into a channel around the front opening. U.S. Pat. No. 3,904,064 discusses the distortion in channeling means that may occur during loading and unloading if the container's floor is uneven, due to it being placed on a roller support or uneven ground. U.S. Pat. No. 3,904,064 was designed to provide a configuration whereby the door panels could be pivoted into position in the channel, rather than sliding each side door into its proper position.

In practical use, however, the pivoting and sliding configurations have the same essential disadvantages. The doors, channels, and connections in both containers are susceptible to being bent for the reasons cited in connection with U.S. Pat. No. 3,915,327 above.

U.S. Pat. No. 4,212,406 to Mittelmann, et. al. (1980) and the other following patents disclose a one-piece door that has the same disadvantages discussed above. The door may be attached by hinges, preferably to the overhead rod of the doorway and releasably attached to the sideposts of the doorway by a series of hook-like members. Several flexible belts stretch across the door and their hook-shaped members engage in grooves in the profile rods.

U.S. Pat. No. 3,598,273 to Rau, et. al. (1971) discloses a similar approach utilizing a one-piece door panel. The bottom of the door slips into a track on the container's platform, the top of the door is hinged to the container, and the door is attached to the container by multiple latches.

U.S. Pat. No. 3,485,406 to Borden, (1969) discloses a similar approach of a single door inserted into channels around the container's front opening and attached to the container by hooks.

Logistical problems and occupational health hazards posed in stowing removable door panels Containers having removable door panels pose a potential occupational safety hazard and logistical problem while the container is being loaded and unloaded. There is no structural method for securely stowing the door panels to the container after they have been removed.

Door panels can be misplaced or lost in high winds. A more dangerous hazard is posed if an outside loading area is hit by a sudden blast from a jet engine. Such blasts can occur when a jet's engine has been started and it is building fuel pressure and revolutions per minute to get "warm". Due to their nature, the momentum of the engine builds slowly and suddenly it accelerates for an instant, even though no additional power has been applied by the pilot.

This sudden acceleration creates a blast from the engine. Some loose door panels hit by such blasts have been blown hundreds of yards through the air at high speed, posing a danger to anyone nearby.

U.S. Pat. Nos. 3,907,148, 3,860,138, and 3,672,529, discussed above, provide a method intended to stow door panels on top of the container by folding the panels up and sliding them back onto the container top by a roller or slide track mechanism. In actual use, this method has disadvantages. The rollers and tracks become loose over time and allow the door to fall off the track, thus becoming inoperable or not operating as designed.

Air cargo containers using affixed doors on hinges

U.S. Pat. No. 3,972,437 to Lovich, et. al. (1976) discloses a container with a single door secured to the container framework by a multiple hinges and a three-way latch assembly. Rather than slipping into a channel on the base of the container, rubber seals are affixed along the top and bottom of the door and are intended to provide a seal when the door is closed.

This confutation has disadvantages that reflect several problems that have not been effectively addressed by the air cargo industry. First, the single door affords limited access for loading and unloading the container. The door's sideways swing-out movement also makes it difficult to fully open the door in crowded or confined areas. Also, the reliance on multiple hinges and latches for the door to open, close, and be secure poses the kinds of operational and maintenance disadvantages discussed above. The rubber seals required by this kind of container also demand close inspection and maintenance for faults at any point in the seal, and generally require replacement two times each year.

U.S. Pat. No. 3,040,925 to Mills (1962) discloses a collapsible cargo container with a single door on two side hinges. This container has the positive feature of affording wide access to the container for loading and unloading. In use, however, the container has the disadvantages of relying on a hinge mechanism, rubber seals, a door that swings open sideways. This door motion is a particular problem with a hinged door of this size. In fact, when it is open it would cover up access to a container placed next to it. Thus, such containers cannot be placed next to each other during loading and unloading.

Air cargo container adapted for shipping garments

U.S. Pat. No. 4,674,645 to Instone, et. al. (1987) discloses a collapsible freight container that is particularly intended to convey garments by air. Garment hangers are attached to a roof that slides forward during loading and unloading. This design has the significant disadvantage that, if a full load of clothing is on the hangers when slid forward, the entire container may tip over from the weight. Another disadvantage is that the hanging bars are stationary. This does not easily allow garments of different sizes to be accomodated. Yet another disadvantage is that, with a sliding roof, there may not be a watertight seal at all edges of the roof, thus posing a threat of water damage to cargo. Lastly, the front panel of this container attaches by way of latches and there is no disclosed method for securely stowing it to the container during loading and unloading.

Plastic shipping container utilizing a door/container wedge

U.S. Pat. No. 3,828,965 to Yarbrough (1974) discloses a plastic container that is not a certified air cargo container but which should be noted. This cargo container does not meet the standards for FAA-certified use as a stand-alone integral part of the aircraft. It is useable for air freight only if it is placed inside a certified air cargo container or placed on a pallet and covered completely with netting and straps.

This patent has one configuration involving a removable door that wedges to a narrow lip or flange around the door opening on the container. One disadvantage of this particular design, however, is that rubber gaskets between the door and door opening flanges, and along the bottom of the door, are needed in order to provide a seal. Another disadvantage is that there is no means for securely stowing the door during loading or unloading.

Disadvantages of existing air cargo containers

Thus, all the air cargo containers heretofore known suffer from a number of disadvantages:

(a) Containers with fabric-based structure:
  i) lack the structural strength to prevent or deter pilferage of cargo.
  ii) lack the structural integrity to provide an adequate barrier against environmental elements such as water, wind, dust, heat, and cold. These disadvantages worsen when the fabric is ripped or torn.
  iii) lack the structural rigidity to protect cargo from impacts from outside the container.

(b) Containers with fabric or cardboard-based structure often require numerous straps, belts, and netting, along with adjoining rings, cleats, and other fasteners to surround the container in order to provide structural integrity. When these items are draped over a major portion of the container's surface area, they are susceptible to getting caught or snagged in forklift blades and other moving objects during loading, unloading, and transport. They are also susceptible to failure, thus requiring constant close inspection, frequent maintenance or repair, and full replacement approximately two times per year.

(c) Containers that have attempted to provide greater structural integrity than fabric, by providing rigid doors or front panels:
  i) frequently provide limited loading access. This limits the use of these containers for larger pieces of cargo and increases the time and effort required to load the container.
  ii) have often relied on mechanisms whereby the door units slide or pivot into a narrow channel surrounding the container's cargo loading opening. The "fit" between the door and channel can be easily distorted or bent out of shape if the door is hit by forklift blade or other object, or if the cargo settles or moves suddenly during transit and pushes into one of the door panels. This distortion makes the container highly susceptible to water damage and other environmental elements.

(d) Some containers have attempted to provide removable door panels that use a rubber seal around the door unit and attach the door to the container's cargo loading opening by a hinge mechanism, sometimes in combination with latches or hooks. The disadvantage with hinges and similar affixed devices are:
  i) hinges are a moving mechanism, are frequently fragile in construction, and are susceptible to damage from impacts outside or inside the container. Such damage may prevent proper operation of the door unit and increases the risk of water damage and other elements.

ii) hinged door units can be quietly pilfered with a screwdriver or other instrument.

iii) hinged doors that open sideways are often difficult or impossible to use in a confined or cramped area.

iv) reliance on multiple hinges, latches, hooks, or other similar devices adds a significant number of steps to the process of maintaining and using the container. It adds a number of points on the container that must be constantly inspected to confirm they are operating correctly and are secure, and which must be periodically repaired and replaced.

v) rubber seals or gaskets must be carefully inspected by maintenance crews constantly to verify that they do, in fact, maintain a tight seal against the elements. The rubber seals do wear out and must be replaced approximately twice a year by a trained technician.

(e) In order to provide wider access to the container for loading and unloading, some containers have been designed with a multiple door panels that are removeable. Disadvantages of these configurations are:

i) for the door units to provide a proper seal for the container, they must engage with each other perfectly and the combined door units must engage with the container perfectly. In daily use, during which the containers sustain considerable "punishment" during loading, unloading, and transport, "perfection" is not realistic. A container whose integrity depends on various fragile elements to work together perfectly provides various "stress points" or "weak spots" where an impact, sloppy movement by forklift or other device during loading—or simple wear and tear through repeated use—will make the container ineffective for protecting the cargo and providing a necessary seal.

ii) these containers frequently lack a method for securely stowing the panels to the container in a way that will withstand high winds or jet engine blasts. This creates a risk of loss and a serious threat to human life both in and outside the immediate cargo handling area.

(f) Containers that have been designed to stow door units on top of the container suffer from the disadvantage of the rollers and tracks becoming loose over time, thereby allowing the door to fall off the track and become loose or inoperable.

(g) Containers designed for transport of garments have not been configured to accomodate "less-than-container" loads. The reason is that existing containers are not configured to allow effective grouping of garments by destination or identity of shipper. Shippers will less-than-container loads have thus been faced with the choice of either paying the full-container shipping rate (with considerable empty, wasted space), using several smaller air freight containers, or using alternate shipping means.

Most have chosen alternate means such as boats. Small businesses find that their cost margins cannot justify purchasing an entire large container and that the administrative task of monitoring a number of smaller containers simply is not worth the effort. In effect, this has kept these businesses out of the air freight market.

Existing garment-oriented units also lack the flexibility for the hanging devices to accomodate cargo of various sizes. This has led to inefficiency in shipping such cargo.

Objects and Advantages of the Invention

Several ojects and advantages of the air cargo security vault are:

(a) to provide an air cargo container having an opening on one wall of such predetermined size that, except for a narrow upper edge and two narrow generally opposing lateral edges around the opening, affords substantially full access to the container (hereafter referred to as "a container") for efficiently loading and unloading a variety of large and small cargo pieces (including access by trolleys and similar devices). The opening is securely sealed by a removable, single rigid door panel, rather than by fabric, netting, or hinged panels.

(b) to provide a container that can be securely enclosed by directly engaging a single rigid door panel directly over the peripheral edges of a structural channel that goes around the top and sides of the container's opening, such direct engagement cooperating to create a secure, watertight seal without the need for hinges, rubber seals or gaskets.

(c) to provide a container that, when enclosed, has a door panel that engages directly and cooperates with the peripheral edges of a structural channel around the top and the sides of the container's opening to distribute evenly around the opening any weight stress against the panel. This eliminates stresses that would otherwise accumulate at a limited number of connection points along the opening's edges if a panel or other covering were connected to the container by hinges, hooks, nets, or straps. This is designed to minimize or eliminate the bowing movement that may distort the edges. The cooperation between the panel and channel additionally provide a much stronger retstraint against cargo movement.

(d) to provide a container with a door panel having a rigid extrusion running horizontally across its exterior surface, thus making the exterior surface rigid and thereby eliminating stress cracks from cargo being pushed against the interior surface of the panel during transport. The extrusion also serves as a "runner" to prevent the container from getting wedged into a truck or trailer while being unloaded.

(e) to provide a container with a single rigid door panel that overlaps all peripheral edges of the body around the container's opening, thus protecting the edges from impacts and damage.

(f) to provide a container with a single rigid door panel that, when attached, seals the container with an overlapping uniform exterior surface that provides superior protection against impacts and pilferage, and provides a superior seal against water, wind, dust, humidity, extreme temperatures, smoke, and other environmental elements.

(g) to provide a container whose security against pilferage, impacts, and environmental elements enables a wider variety of theft-prone, high-value cargo to be shipped by air cargo container, and to a wider range of destinations where the risk of pilferage is particularly high.

(h) to provide a container whose security against environmental elements enables air freight companies to ship a wider variety of cargo on routes and to destinations having extreme climatic conditions.

(i) to provide a container whose security against impacts and jostling enables air freight companies to ship a wider variety of cargo on routes and to final destinations where the rigors of storing, loading, unloading, and aircraft loading may be particularly harsh, due to the nature or sophistication of the facilties available or practices used.

(j) to provide a container body whose simple construction and elimination of many common affixed attachments such as hinges, rollers, and rubber seals or gaskets will offer a longer life of useful service, greater reliability in operation, and reduced maintenance expenses, while providing significant advantages over existing containers in terms of structural strength, security against pilferage, ease of use, and efficiency of loading and unloading.

(k) to provide a container with a door panel that can be securely stowed on the container during loading and unloading without the use of rollers or fasteners, and which will remain secured to the container even in high winds or if the container is hit by a sudden jet engine blast.

(l) to provide a container adapted for suspending cargo during transport, such as garments, which allows the various shapes and sizes of cargo to be accomodated and grouped as determined by the carrier, with maximum space utilization, and with superior protection against creasing and other damage.

(m) to provide a container for suspending cargo during transport, such as garments, which enables the cargo to be hung at the point of origin in identifiable lots based the final destination, thus reducing the time necessary to identify, unload and forward the cargo to its destination.

(n) to provide a container for suspending cargo during transport, such as garments, which enables the cargo to be hung at the point of origin in identifiable lots based on the owner of the cargo, thus enabling the cargo container to be used for a number of less-than-container shipments from various shippers. This will open up the air freight system to customers who primarily have small shipments—particularly small businesses—and will enable air freight companies to access this segment of the air cargo market.

(o) to provide a container having a rigid body unit that does not contain any hinges, rubber seals, or gaskets. The peripheral edge around the opening may be fitted with two hasps (not shown in Drawings) for locking the door panel to the body. This removal of most of the typical features that are foreign to the body unit will simplify production and provide cost-reduction opportunities in the manufacturing process. This simple design and construction also offers the potential for superior efficiency for recycling the body unit after the container's useful life of service is over. The challenge of "retiring" containers is gaining greater prominence in the air cargo industry as a facilities management and financial problem. Retirement of containers through recycling or a similar materials recovery means, rather than disposal by landfill, should be a proactive management step by carriers as being a preferrable long-term policy and prudent planning for future regulatory trends.

(p) to provide a removable door panel of rigid material that minimizes the physical presence and exposure of tie-down straps and increases their useful life by:

i) concealing the major portion of each tie-down strap on the interior surface of the panel and enabling the strap to pass to the panel's exterior surface through a slot, and ii) providing an indentation on the exterior surface of the panel that places the strap significantly behind the surface plane of the metal extrusion surrounding the container's floor.

(q) to provide a new kind of security against pilferage and environmental elements, structural strength, ease of use and maintenance, and longer useful life for existing air cargo containers having a structural channel around their opening (most of which are commonly referred to as "A Containers"), by providing:

i) a removable door panel of rigid material that can be utilized on such containers with minimal, if any, adjustments to the container. Most of these containers are currently using other types of front coverings such as nets and curtains.

ii) a means for securely stowing the removable door panel to the container via a structural channel that can be retrofitted into air cargo container's body and which will engage with the door panel for stowing. Those containers that are already in use have no second structural channel to accept the door panel.

(r) to provide a new kind of security against pilferage and environmental elements, structural strength, ease of use and maintenance, and longer useful life for existing air cargo containers that do not have a structural channel of any kind, by providing a means for retrofitting such containers with two structural channels with edges that can engage with a removable door panel.

Still further objects and advantages will become apparent from a consideration of the ensuing description and drawings.

DRAWING FIGURES

FIG. 1 is a perspective view of an air cargo container.

FIG. 2 is an air cargo container that has been adapted for suspending or hanging cargo, such as garments, during flight.

FIG. 3 is a left side elevation of an air cargo container.

FIG. 4 is a top elevation of an air cargo container.

FIG. 5 is an enlarged section of FIG. 1's disclosure of the interior surface of the door panel.

FIG. 6 is an enlarged left side elevation of FIG. 1's disclosure of the exterior surface of the door panel's straps, buckle, and fasteners.

Figure 1:
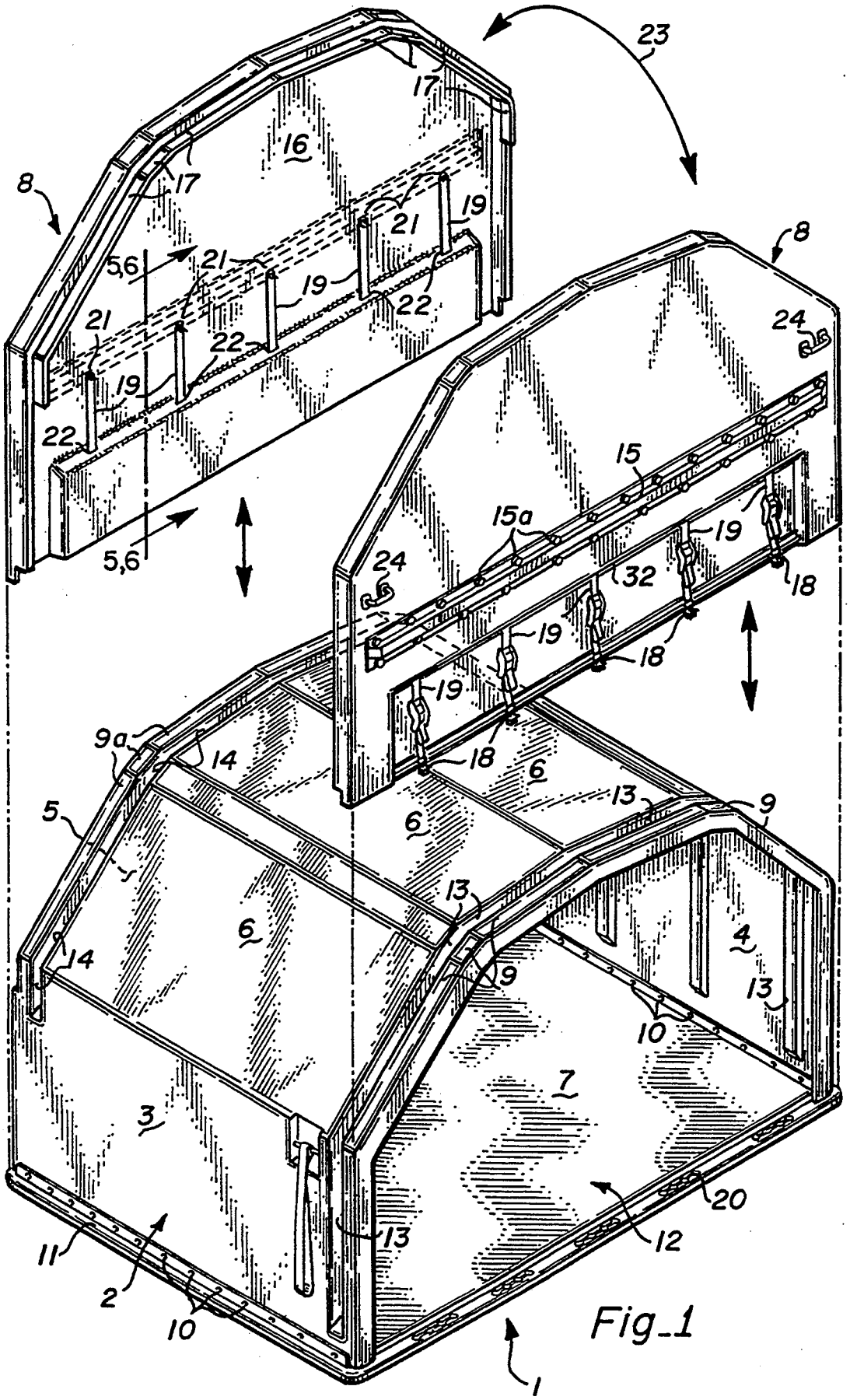
FIGS. 1–6 are illustrations of one embodiment of the present invention.

REFERENCE NUMERALS IN DRAWINGS 1 an air cargo container 2 container body (comprised of side walls, rear wall, top)

2A a stiffener of rigid material affixed to the interior surface of the body 3 a side wall
4 a side wall
5 a rear wall
6 a top
7 a floor
8 a removable door panel
9 peripheral edges of the container's opening
9A peripheral edges of the container's rear (or other side)
10 steel bolts or other fastening means
11 extruded edge members encompassing floor
12 opening of container
13 a structural channel behind peripheral edges of opening
14 a structural channel at rear of container
15 an aluminum extrusion on exterior surface of door panel
16 an interior surface of door panel
17 a peripheral flange on sides, top, interior surface of door panel
18 a fastener
19 a tie-down strap
20 a seat-track in portion of extruded edge member that encompasses floor
21 a fastening means for attaching tie-down strap to interior surface of door panel
22 a slot on interior surface of door panel through which tie-down strap passes to exterior surface
23 an illustration that door panel can be securely engaged with the edge around the rear structural channel while the container is being loaded and unloaded, and that it can be securely engaged in the edge around the structural channel near the opening, such engagement securely sealing the container during shipment
24 a handle located on the door panel's exterior surface which are used to lift the door panel slightly so that its peripheral flange engages the opening's structural channel
25 an air cargo container that has been adapted for suspending or hanging cargo, such as garments, during transport
26 in an air cargo container adapted for suspending or hanging cargo, a vertical or horizontal member providing a framework attached to the floor
27 in an air cargo container adapted for suspending or hanging cargo, a bar extending between the horizontal support members
28 in an air cargo container adapted for suspending or hanging cargo, a strap or rope that are used to suspend cargo from the bars
29 in one possible embodiment of a fastener, a bolt which may cooperate with a nut to fasten the tie-down strap to the interior surface of the door panel
30 in one possible embodiment of a fastener, a nut which may cooperate with a bolt to fasten the tie-down strap to the interior surface of the door panel
31 an upper edge on the lower portion of the door panel's exterior surface
32 an angle on the lower portion of the door panel's exterior surface
33 a lower edge on the lower portion of the door panel's exterior surface
34 a buckle for cinching tie-down strap, to create taut pressure Description—FIGS. 1 to 6

Figure 3:
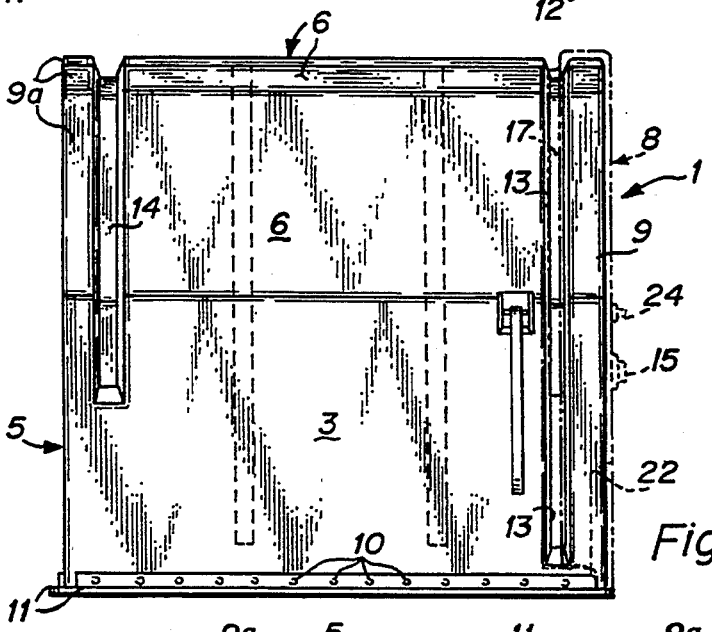
Figure 4:
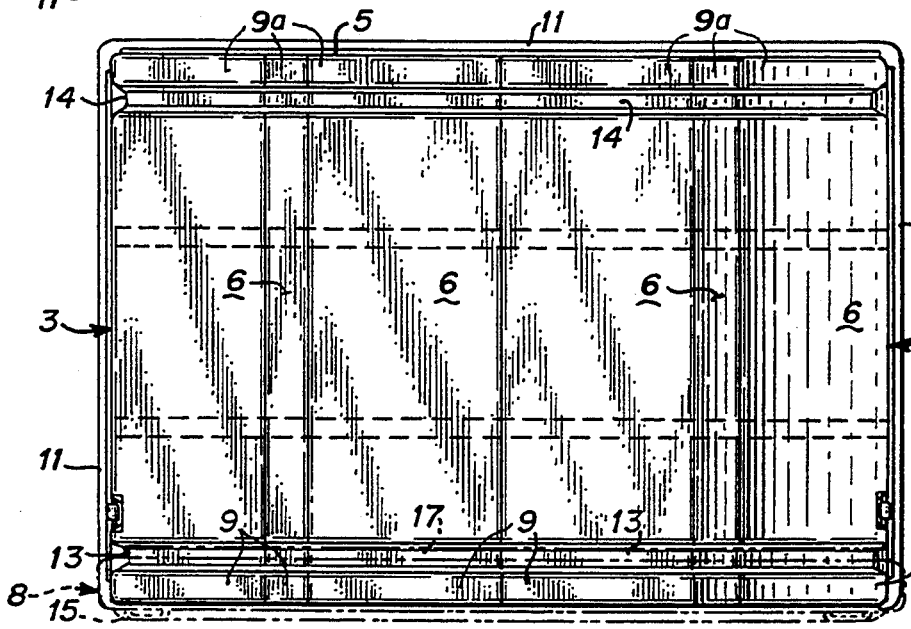

One possible embodiment of the air cargo security vault is illustrated in FIG. 1 (perspective view), FIG. 3 (side view) and FIG. 4 (top view). It can be seen that the cargo container of the invention is designated generally by the numeral 1. A container 1 fundamentally comprises a body 2 comprising a side 3 and a side 4, a rear wall 5, a top 6, a floor 7, and a removable door panel 8 that is sized to overlap the peripheral edges 9 of a front opening 12 of container 1. Floor 7 may be of various different constructions and may be in the form of a pallet. Body 2 and door panel 8 may be of various different configurations and may be constructed of fiberglass, aluminum, plastic, or a similar rigid material that is lightweight and yet provides strength. A stiffener 2A comprised of a compatible rigid material is affixed to the interior surface of the body at various locations to provide added structural strength.

Body 2 is attached to floor 7 by a plurality of steel bolts 10 or other securing means that provide a strong bond.

Floor 7 is most preferrably of a configuration and material which provides for lightweight strength and rigidity.

Floor 7 is encompassed by extruded edge members 11 which are functional for providing securing means to the vertically extending elements of container 1 and for covering the edges of the material used to construct floor 7.

As can be seen in FIGS. 1,3, and 4, immediately behind a peripheral edge 9 of an opening 12 there is a continuous structural channel 13 that encompasses the entire length of peripheral edge 9. Structural channel 13 rises vertically on side 3 and side 4 of body 4 and continues over top 6 of body 2.

As can be seen in FIGS. 1, 3, and 4, near rear 5 there is a peripheral edge 9A and a structural channel 14. Structural channel 14 runs continuously from side 3 and side 4 over top 6 so as to make an uninterrupted channel 14 in body 2.

As can be seen in FIG. 1, door panel 8 has on its exterior surface an extrusion 15 constructed of aluminum or a similar material that is lightweight but which provides strength. On its interior surface 16, door panel 8 has a peripheral structural flange 17 on a portion of its sides and across its top. Flange 17 is of predetermined shape and design so as to entirely overlap peripheral edges 9 and 9A when door panel 8 is fully engaged with either edge 9 or 9A.

Figure 6:
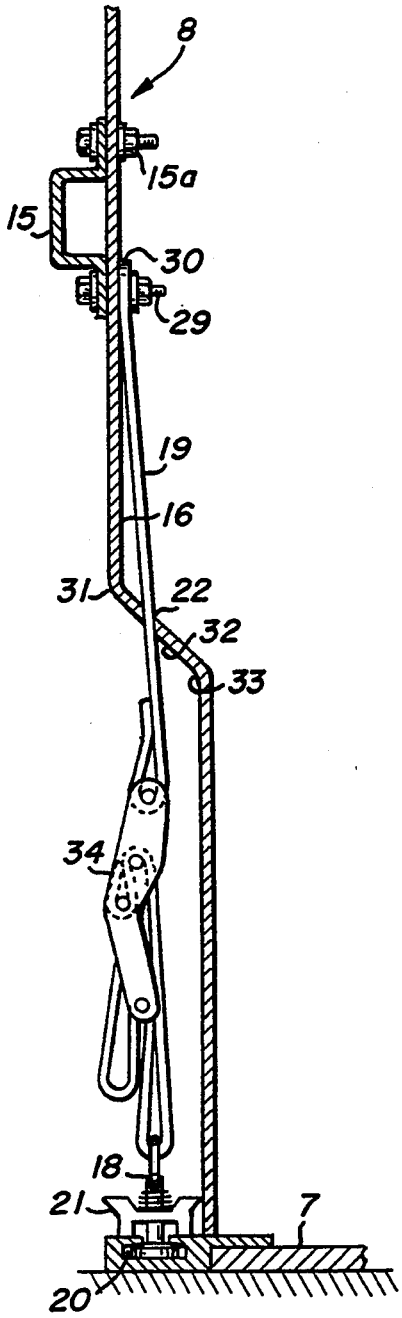

Door panel 8 also has fasteners 18 and tie-down straps 19 that slip into a seat-track on extrusion 20 when door panel 8 is attached to body 2. This cooperation between a fastener 18 and seat-track 20 is shown in FIG. 6. FIG. 6 also discloses greater detail about a buckle 34 that is used to cinch to a taut pressure tie-down strap 19 after fastener 18 has been inserted into seat-track 20.

Figure 5:
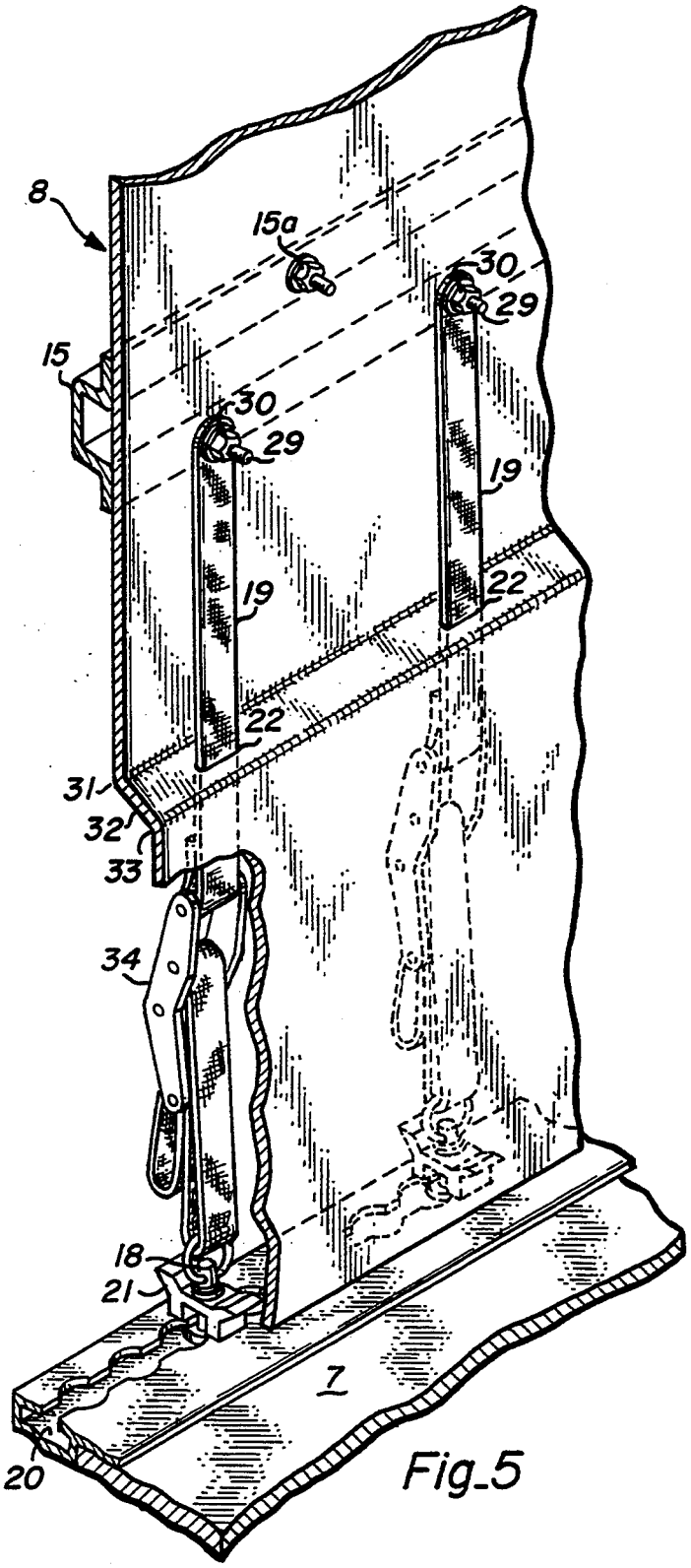

As shown in FIGS. 1, 5, and 6s' view of door panel's interior surface 16, each tie-down strap 19 is secured to door panel 8 by a permanent fastening means 21. Tie-down strap 19 extends downward and passes through a slot 22 that creates a passageway between interior surface 16 and an exterior surface of the door panel 8. As shown in enlarged detail in FIG. 5, tie-down strap 19 passes through a slot 22 of predetermined design and size so as to present a minimal gap between tie-down strap 19 and an edge of the slot 22.

As additionally shown in FIG. 5 and in FIG. 6, exterior surface of door panel 8 has an upper edge 31, an angle 32, and a lower edge 33. If water comes into contact with the panel—even at fire hose strength—these features move the water downward and off exterior surface of door panel 8. Tie-down strap 19, its close fit with slot 22, upper edge 31, angle 32, and lower edge 33 cooperate to prevent water or other environmental elements from entering container 1 through slot 22, without the need for a rubber seal, gasket, or similar device around slot 22.

Figure 2:
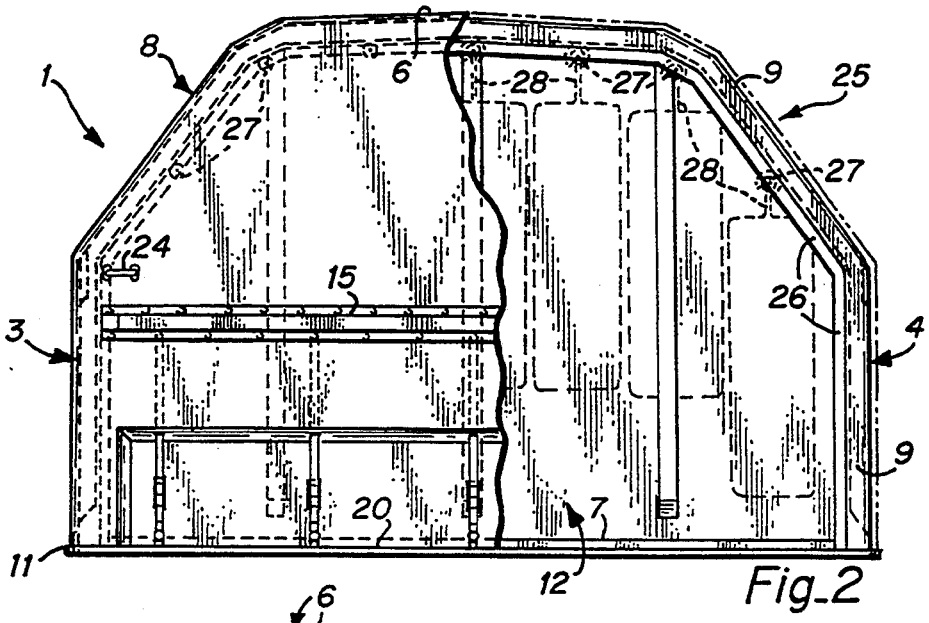

Door panel 8, peripheral edges 9 and 9A, and structural channels 13 and 14 are of such predetermined design and shape that door panel 8 can engage securely with and overlap either peripheral edge 9 or 9A of channel 13 or 14, as indicated in FIGS. 2 and 3. Peripheral edge 9A has a slightly narrower width. The reason is that interior surface 16 of the door panel 8 has a slight indentation that can best seen in FIGS. 5 and 6 and which is indicated by the shape of upper edge 31, angle 32, and lower edge 33. When door panel 8 is secured over opening 12, this indentation does not interfere with proper positioning. However, when door panel 8 is stowed away from opening 12, the indentation becomes a factor and would prevent a straight vertical position if peripheral edge 9A were as wide as peripheral edge 9. To accomodate this, peripheral edge 9A has a slightly narrower width.

Also shown in FIGS. 1 and 3 are handles 24 which are used to lift door panel 8 when it is attached and removed from peripheral edge 9 or 9A and structural channel 13 or 14.

FIG. 6 discloses that a fastening means 21 for tie-down strap 19 can be comprised of a bolt 29 and a nut 30.

FIG. 2 discloses a container generally designated by the numeral 25 that has been adapted for suspending or hanging cargo during transport. In this configuration of the invention, vertically and horizontally extending members made of aluminum or other lightweight material providing rigid strength 26 provide a framework attached to floor 7, which may be a single or double floor configuration. A plurality of bars 27 extends between horizontal members 26 of the framework. Both ends of each bar 27 are secured to horizontal members 26 of the framework by a bolt that attaches into a mounting fixture. Two or more of bars 27 are removeable. Straps or ropes 28 are attachable to bars 27 and cargo is suspended from straps or ropes 28.

Operation—FIGS. 1, 2, 3, 4, 5, 6

In general air cargo use, container 1 is loaded with cargo, and sealed by securing door panel 8 over opening 12 and onto body 2. Container 1 is then loaded into the aircraft by K-loader, forklift, or similar means. Once inside the aircraft, container 1 is moved into a specific area of the aircraft by being rolled along a floor containing ball transfer units. Once inside the designated area, container 1 is made an integral part of the aircraft by floor 7 being clamped to a portion of the aircraft's body.

However, some methods of operating the present invention are quite different operating containers with current configurations. As is best shown in FIG. 1, opening 12 provides substantially full access for loading and unloading cargo. Thus, loaders can use trolleys, handtrucks or similar devices to place several pieces of cargo into container 1 and onto floor 7 at once. These loading devices can be rolled onto floor 7. This high degress of access through opening 12 also allows large, cumbersome, or lengthy cargo pieces to be easily loaded, without the person having to twist and turn through a doorway of limited size. These two features make loading and unloading easier and faster.

Once the cargo is loaded, two persons of either sex can easily attach door panel 8 to container 1, thus completely closing off opening 12 and providing a secure, watertight enclosure. To do this, each person stands on one side of door panel 8 and holds handle 24. The two persons stand door panel 8 immediately in front of opening 12. They then lift door panel 8 approximately forty-eight cm (48 cm) above the ground and move door panel 8 toward container 1 and, in particular, toward peripheral edges 9. Interior surface 16 eventually is flush against the front face of peripheral edges 9 on sides 3 and 4. Door panel 8 is now lowered down by the two persons. As it is lowered, structural flange 17 engages directly with peripheral edges 9. Door panel 8 now completely overlaps peripheral edge 9.

In this position, structural flange 17 cooperates with peripheral edge 9 to create a tight, secure seal and completes an enclosure of body 2.

To provide final securing, each fastener 18 on tie-down strap 19 is slid into seat-track 20. Buckle 34 is then pulled upward until the pressure of each tie-down strap 19 is taut.

Door panel 8 is removed from container 1 in a similar fashion, with the steps essentially in reverse order. Buckle 34 is moved back to its resting position and tie-down strap 19 loses its tautness. Fastener 18 is slid out of seat-track 20. The two persons take hold of handle 24 and elevate door panel 8 to a height that is approximately forty-eight cm (48 cm) above the ground. This elevation allows structural flange 17 to clear peripheral edges 9 of opening 12. This occurs because, at this approximate height, a cutaway portion of interior surface 16 of door panel 12 is now the only portion of interior surface 16 in contact with peripheral edge 9.

The two persons, each holding handle 24, carry door panel 8 to rear wall 5. They position door panel 8 so that interior surface 16 immediately faces an exterior surface of rear wall 5. The two persons lower door panel 8 and structural flange 17 over peripheral edge 9A until the edge 9A is completely overlapped by structural flange 17. This operation is essentially the same as that used to secure door panel 8 into place over opening 12.

When door panel 8 has been secured to peripheral edge 9A, the bottom edge of door panel 8 is elevated approximately two to three cm (2–3 cm) above ground level, thereby keeping door panel 8 out of water puddles, mud, dirt, or similar elements that may interfere with keeping the container and cargo in the best condition possible. This operation also keeps door panel 8 out of the way while cargo is being loaded and unloaded. Structural flange 17 and peripheral edge 9A engage directly and cooperate to create a tight, secure seal that will keep door panel 8 secured to body 2 even in extremely high winds or if container 1 is hit with a jet engine blast from aircraft that is taxiing in the area or preparing for flight.

One of the objects and advantages of the present invention is to enable owners of air cargo containers already in service to take advantage of the invention's benefits. Containers currently in use that are commonly designated as "A" containers already have a peripheral structural channel around their opening, similar to structural channel 13. Most existing containers of this design would presently be using a fabric-based material and netting to cover their opening. By supplying these containers with a door panel such as that designated by the numeral 8 in FIG. 1, 3, 4, 5, and 6, these containers can enjoy a significant new level of security against pilferage, structural strength, seal against water and other environmental elements, ease of use, and longevity of service.

Owners of these existing containers may also want the ability to securely stow door panel 8 to the container body. These existing containers do not have the second structural channel that is designated by numeral 14 in FIG. 1, 3, and 4. Nevertheless, one advantage of the present invention is that structural channel 14 can be retrofitted into an existing container. As can best be seen in FIG. 3 and 4, structural channel 14 is of a predetermined length and depth. The sides and top of an existing container can be retrofitted in this manner: First, a template of the exact shape and dimensions of structural channel 14 is affixed to the container's sides and top by strong adhesive tape. Using a saw or other tool appropriate for creating a cutout in the body, the sides and top are cut in conformance with the template and the rigid material is removed. Structural channel 14, made of a single piece of rigid material of predetermined shape and dimensions so as to securely fit the newly-created cutout in the sides and top, is then attached to the container. Structural channel 14 is first attached by a rivet or similar fastening means, and is then further secured into the cutout area by epoxy or similar fixative material. This same basic procedure can be used for containers whose bodies are made from fiberglass, plastics, or aluminum, with adjustments in tooling and fastening means to accomodate the particular body material.

This retrofitting procedure can also be used to add structural channels comparable to structural channels 13 and 14 to existing containers that presently have no such channels or which are in different embodiments that the air cargo container illustrated in FIGS. 1, 2, 3, 4, 5, and 6.

The present invention can be specially adapted for suspending cargo, such as garments, during transport and flight. In current industry practice, cargo such as garments are not hung. Rather, they are stacked vertically from floor 7. FIG. 2 illustrates an embodiment of container I that has been adapted for suspending cargo.

The cargo is loaded and unloaded through opening 12. When loading, the person can move bar 27. This enables the person to use bar 27 to accomodate the sizes of the particular cargo pieces and achieve maximum space efficiency. It also enables the person to minimize overlap of garments and similar cargo, thus keeping the cargo in the best, non-wrinkled condition possible.

The present invention also changes the operation of current practices in that the person can efficiently organize cargo into groups based on the cargo's destination or by the identity of the shipper. This ability to efficiently organize cargo by groups also enables the carrier to ship less-than-container loads of various shippers. Grouping cargo will require such cargo to be labelled with an easily-recognizable identification means.

Bar 27 is removed by taking out a bolt or similar fastener that is on each end of bar 27 where it attaches to horizontal member 26. Cargo is attached to strap or rope 28 suspended from bar 27.

Summary, Ramifications, and Scope

Accordingly, the reader will see that the removable door panel of the air cargo security vault enables substantially full access on one side of the container for loading and unloading. Two persons can easily engage the door panel directly with a structural channel on the body that surrounds the opening, thus creating a secure, overlapping, watertight seal with the body without the need for hinges, rubber seals or gaskets. The door panel is then easily tightened to a seat-track in the container's floor by a simple, stationary tie-down strap and fastener. The door panel overlaps all edges of the body that surround the opening of the container, thus providing superior protection against water and other environmental elements, superior structural strength, and superior protection against pilferage. When the container is ready for unloading, the door panel can be easily removed from the opening and securely stowed directly on the container body without the need for rollers, hinges, or fasteners. Furthermore, the air cargo security vault has additional advantages in that:

(a) it distributes evenly to the body around the container's opening weight stresses such as those that may occur when cargo settles, thus eliminating concentrated stress that may damage or distort the container and providing a much stronger restraint against cargo movement;

(b) it provides an aluminum extrusion on the door panel that eliminates stress cracks from settling cargo and provides a "runner" that prevents the container from getting wedged into a truck or trailer during transport;

(c) it provides a door panel that overlaps and protects all peripheral edges of the body that surround the container's opening, thus minimizing damage or distortion to the body from the rigors of transport;

(d) its superior security against pilferage, impact, and environmental elements enables carriers to ship a wider variety of theft-prone, high-value cargo;

(e) its superior seal against water and other environmental elements enables carriers to ship a wider variety of cargo affected by such elements on routes and to final destinations having extreme climatic conditions;

(f) its superior structural strength against impacts and jostling enables carriers to ship a wider variety of cargo on routes and to final destinations where the rigors of storage, loading, unloading, and transport may be extreme due to unsophisticated physical facilities or handling practices;

(g) its body is of simple construction and eliminates numerous affixed items such as hinges and rubber seals, thereby offering a longer service life, greater reliability, and reduced maintenance expense, while providing significant security and structural advantages;

(h) its method for securely stowing the door panel on the container will eliminate the safety hazard of the door panel becoming a projectile if hit with a sudden jet engine blast or storm-force wind;

(i) it is easily adaptible for suspending cargo, such as garments, with a hanging method that
  i) minimizes wrinkling or creasing of the cargo;
  ii) enables cargo to be grouped by destination, thus reducing the time needed to identify and forward cargo to that destination;
  iii) enables cargo to be grouped by the identity of the shipper, thus enabling carriers to access a new market of small business shippers who ship less-than-container loads;

(j) its body has no hinges, rubber seals or gaskets, and thereby simplifies production and offers cost-reduction opportunities for manufacturers who wish to compete more effectively;

(k) its body provides superior efficiency for recycling or materials recovery methods after the container's service life is over, thereby enabling carriers to reduce disposal costs, alleviate logistical burdens, and plan proactively to deal with general regulatory trends to curtail landfill disposal;

(l) its door panel minimizes the exterior presence and exposure of the tie-down straps, thereby minimizing the risk of their being snagged;

(m) the door panel can be utilized by existing containers having a front structural channel, with minimal adjustments to the container;

(o) existing containers with a front structural channel can be easily retrofitted with the second structural channel for securely stowing the door panel to the container;

(p) existing containers having no structural channels can be easily retrofitted with two channels to accomodate a removable door panel.

Although the description above contains many specificities, these should not be construed as limiting the scope of the invention but as merely providing illustrations of one of the presently preferred embodiments of this invention. For example, the air cargo security vault can have other air cargo container shapes and configurations as are certified by the Federal Aviation Administration for use as an integral part of the aircraft.

Thus the scope of the invention should be determined by the appended claims and their legal equivalents, rather than by the examples given.

What is claimed is:

1. An air cargo container (1) comprising:

a. a unitary container body (2) having a floor (7) with a top surface for placement of cargo;

b. a body of rigid material attached to and creating an enclosure over said top surface of said floor (7), the body including at least two opposing sidewalls (3, 4) joined to said floor (7), a top wall (6) joined to said sidewalls (3, 4) and a rear wall (5) joined to said floor, (7) said sidewalls (3, 4) and said top wall (6) the body having an opening (12) opposite said rear wall (5) and of predetermined size to provide substantially full access to the interior of said enclosure, and with a peripheral edge about an upper and generally opposed lateral side edges of said opening (12);

c. a unitary slidable door panel (8) being slidably removable and detachable from the body and having an exterior surface and an interior surface;

d. a means for sealing (9, 17) said body directly with said door panel (8) about said peripheral edge and said opening (12) and for subsequently removing said door panel (8) from about said opening (12) and said peripheral edge;

e. a means for storing and securely engaging (9*a*, 17) said door panel (8) directly with said body about said rear wall when said door panel (8) is removed from said opening (12), whereby said door panel (8) remains stationary on said body (2) when removed from about said opening (12).

2. The air cargo container of claim 1, wherein a channel (13) is formed intermediate said peripheral edge within said top wall (6) and two opposing sidewalls (3, 4) and a slotted edge (9) is formed intermediate the channel (13) and said opening (12) with the door panel (8) being insertable in said edge (9).

3. The air cargo container of claim 2, wherein said top wall (6), sidewalls (3, 4), rear wall (5) and door panel (8) are comprised of a rigid plastic material.

4. The air cargo container of claim 2, wherein said door panel (8) is directly engagable with said edge (9), and removable from about said edge (9) by means of cooperation of a peripheral flange (17) formed on said interior surface of said door panel (8) that overlaps and creates a secure seal with said peripheral edge (9) when positioned over said edge (9).

5. The air cargo container of claim 4, further including a fastening means (18, 19, 20) for releasably fastening said door panel (8) about said top surface of said floor (7).

6. The air cargo container of claim 5, wherein the fastening means (18, 19, 20) comprises:

a. a seat track receptable (20) secured about said top surface of said floor (7) about said opening (12), b. a plurality of fasterners (18), each of said fasteners being of predetermined size so as to removably engage said receptacle (20), and c. a cinching device (34) attached to said fasteners (18) and to said door panel (8) with means for adjusting the tautness of the engagement between said fasteners (18) and said receptable (20).

7. The air cargo container of claim 1, further comprising:

a. a framework of vertical and horizontal members (26) about said top wall (6) and sidewalls (3, 4), said members (26) attached over said top surface of said floor (7) and to the interior of said body (2), b. a plurality of bars (27) extending between said members (26), said bars (27) being removably secured to said members (26) by a mounting fixture, and c. a hanging device (28) attached to said bars (27) for suspending cargo.

8. An air cargo container with a removable door structure, the combination of:

a. an air cargo container comprising a floor (7) and a body (2) enclosing said floor (7) with a top side wall (6), lateral sidewalls (3, 4) and a rear side wall (5) with an opening (12) opposite said rear side wall (5);

b. a structural channel (13) in the exterior surface of said body (2), said structural channel (13) having a peripheral edge extending substantially horizontally along an edge of said top side wall (66) and substantially vertically along a portion of edges of said sidewalls (3, 4) and about said opening (12), c. a slideable panel (8) of rigid material of predetermined size to enclose said opening (12), said panel (8) having an exterior surface and an interior surface, said interior surface engaging a structural flange (17) about the top edge and extending over a portion of the side edges of said interior surface, said flange (17) being of predetermined length so as to entirely overlap the peripheral edges (9) of said structural channel (13) and create a secure, watertight seal that distributes weight stresses evenly to said body around said opening, d. a fastening means (18, 19, 20) for removably fastening said door panel (8) to said top surface of said floor (7), and e. a means about said rear side wall for securely engaging said door panel (8) directly with said body (2) while said opening is exposed (12), whereby said door panel (8) remains stationary on said body (2) when removed from about said opening.

9. The air cargo container of claim 8, wherein said fastening means comprises:

a. a seat track receptable (20) secured to said top surface of said floor (7) about said opening (12), b. a plurality of fasteners (18), each of said fasteners *18) being of predetermined size so as to removably engage with said receptable (20), and c. a cinching device (34) attached to said fasteners (18) and to said door panel (8) with means for adjusting the tautness of the engagement between said fasteners (18) and said receptacle (20).

10. An air cargo container (1) comprising, in combination:

a floor panel (7) of rectangular shape and having a top surface;

a pair of lateral side walls (3, 4) engaged about two opposing lateral edges and said top surface of the floor (7), the side alls (3, 4) projecting normally from said top surface;

a rear wall (5) engaged about one edge and said top surface of the floor (7), the rear wall (5) projecting normally from said top surface and engaged to each of the side walls (3, 4);

a top wall (6) engaged to edges of the side walls (3, 4) and the rear wall (5) to form an enclosure with an opening (12) about edges of the floor panel (7), the side walls (3, 4) and the top wall (6) and opposite the rear wall (5);

a first slotted edge member (9) formed in the top wall (6) about a peripheral of said opening (12);

a unitary door panel (8) of a peripheral shape corresponding to the shape of said opening (12) and having a flange (17) projecting from an interior surface and upper edge of the panel for interlocking with the first slotted edge member, the door panel being slideable parallel to the rear wall over said opening between a first position with the panel separated from the side walls (3, 4), top wall (6), floor (7) and said opening (12) to a second position with the panel engaged to the sidewalls (3, 4), top wall (6), floor (7) over said opening (12) and with said flange (17) engaged to said first edge member (9).

11. The container of claim 10 further including:

a second slotted edge member (9*a*) formed in the top wall (6) about a periphery of the rear wall (5) for interlocking with said flange (17) and securing the door panel (8) in place about the rear wall (5) when the door panel (8) is placed about the rear wall (5) when the door panel (8) is removed from said opening (12).

12. The container of claim 11 further including:

a first channel formed in the top wall (6) and the sidewalls (3, 4) about the first slotted edge member.

13. The container of claim 12 further including:

a second channel formed in the top wall (6) and the side walls (3, 4) about the rear wall (5).

14. The container of claim 12 further including:

a fastening means (18, 19, 20) for releasably fastening the door panel (8) about said top surface of the floor panel (7).

15. The container of claim 13 wherein, the fastening means includes a seat track receptacle (20) secured about said top surface of the floor panel (7) about said opening (12), a plurality of fasteners (18), each of said fasteners (18) being of predetermined size so as to removably engage said receptable (20), and a cinching device (34) attached to said fastener (18) and to the door panel (8) with means for adjusting the tautness of the engagement between said fasteners (18) and said receptable (20).

* * * * *